US005156403A

United States Patent [19]

Martino

[11] Patent Number: 5,156,403

[45] Date of Patent: Oct. 20, 1992

[54] GOLF TEE FOR DRIVING RANGE

[76] Inventor: Louis D. Martino, 3 Oak Hill La., Rome, Ga. 30165

[21] Appl. No.: 848,041

[22] Filed: Mar. 9, 1992

[51] Int. Cl.[5] ..... A63B 69/36

[52] U.S. Cl. ..... 273/195 A; 273/33

[58] Field of Search ..... 273/183 A, 195 R, 195 A, 273/195 B, 196, 197 R, 198, 33

[56] References Cited

U.S. PATENT DOCUMENTS

| | | | |
|---|---|---|---|
| 1,929,579 | 10/1933 | Garlando | 273/202 |
| 2,079,387 | 5/1937 | Sickmiller | 273/202 |
| 2,202,556 | 5/1940 | Jordan | 273/183 A |
| 3,101,949 | 8/1963 | Williams | 273/195 R |
| 3,599,982 | 8/1971 | Elesh | 273/195 R |
| 3,738,660 | 6/1973 | Branz | 273/195 R |
| 3,870,314 | 3/1975 | Bertucci | 273/195 R |

FOREIGN PATENT DOCUMENTS

| | | | |
|---|---|---|---|
| 2107593 | 5/1983 | United Kingdom | 273/195 R |

*Primary Examiner*—Theatrice Brown

*Attorney, Agent, or Firm*—James B. Middleton

[57] ABSTRACT

A golf tee is provided for use with a driving range mat. The tee has a base portion that extends into a hole in the mat, and terminates below the upper surface of the mat. A generally semi-rigid tee portion is slidable in the base portion so the tee portion is vertically adjustable. The base is made of a resilient material, and has an upper wall divided into segments. The hole in the mat may be sized to squeeze the segments inwardly to grip the tee portion more firmly. The tee portion has a base received within the base portion so the tee portion cannot be easily removed from the base portion. The diameter of the base portion is sufficient that the tee portion will not engage the mat when the tee is hit by a golf club, to prevent degradation of the mat.

8 Claims, 1 Drawing Sheet

GOLF TEE FOR DRIVING RANGE

INFORMATION DISCLOSURE STATEMENT

Numerous golf tees have been devised in an effort to solve the many problems related to golf tees. There have been "permanent" golf tees devised, wherein a single tee remains generally in place after the golf ball has been driven from the tee. Also, when the permanent tees are used, the tees must be vertically adjustable to accommodate various golfers. Two examples of these permanent, vertically adjustable tees, are U.S. Pat. Nos. 1,803,907 to Kruse, and 2,079,387 to Sickmiller.

Some of the greater problems with golf tees are encountered on golf driving ranges. It will be understood that, on a driving range, there is a mat having a hole for receiving a tee therethrough. The most commonly used form of tee comprises a tube having a base flange. The flange engages the back side of the mat and the tube extends through the mat and receives a golf ball. The tee is quite effective; however, when the tee is engaged by the golf club during the drive, the body of the tee is jammed into the side of the hole through the mat. With many repetitions of this, the mat begins to split or otherwise degrade at the hole for receiving the tee.

On prior art effort at solving the above stated problem is shown in U.S. Pat. No. 4,902,541 of the present inventor. This involves the reinforcing of the hole through the mat, and reinforcing the mat to prevent tearing or other degradation of the mat. Another prior art effort comprises the use of a tee receiver extending at least partially through the mat, and a conventional golf tee held by the tee receiver. While this arrangement reduces the damage to the range mat, the tees are propelled into the golf range along with the ball. This necessitates both the frequent placing of tees before driving a ball, and the occasional retrieval of a large quantity of tees from the range.

It will therefore be seen that the prior art has not provided a tee that overcomes the above mentioned problems.

SUMMARY OF THE INVENTION

This invention relates generally to golf tees, and is more particularly concerned with a tee assembly for golf mats on a golf driving range, the tee portion being captured, but arranged not to degrade the range mat.

This invention provides a base portion that is at least partially extendible through a hole in a range mat, the base portion preferably terminating short of the surface of the golf range mat so as to minimize the opportunity for the head of a golf club to impact the tee base holder. The base portion is somewhat resilient, and receives a generally semi-rigid golf tee portion having a head for receiving a golf ball thereon and a base for locking the tee portion to the base portion. With this construction, the generally semi-rigid tee portion can move under the force of a golf club, but has much less mass than the base to impact the tee hole side wall, and less opportunity to do so by virtue of its center spacing with the tee base. The larger diameter base portion protects the side wall of the golf tee hole of the golf range mat from damage by spreading the load of the golf club head impact and by isolating the tee. Due to the locking of the tee portion in the base portion, the tee portion will usually not leave the base portion, but will most often remain in place for the next drive.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
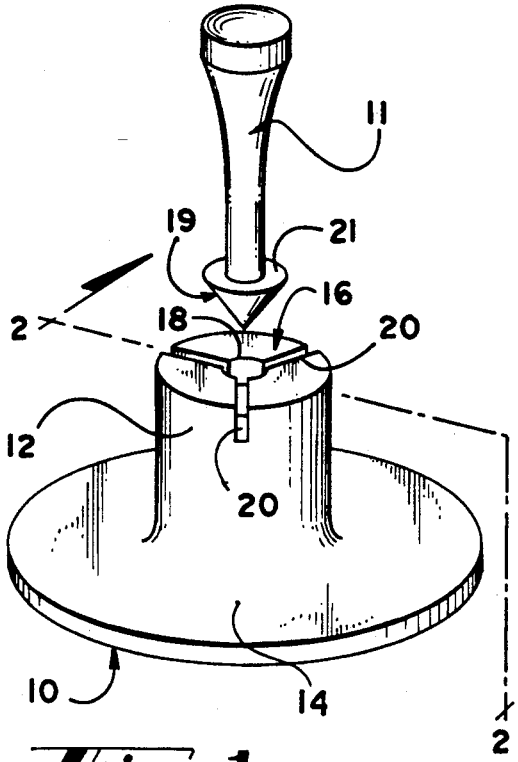
FIG. 1 is a perspective view showing a tee assembly made in accordance with the present invention, the generally semi-rigid tee portion being shown exploded from the resilient base portion.

Referring now more particularly to the drawings, and to that embodiment of the invention here presented by way of illustration, the device shown in FIG. 1 comprises a resilient base portion 10 and a generally semi-rigid tee portion 11. The base portion 10 includes a post 12 that is extendible through an appropriate hole in a golf range mat, and a flange 14 at the lower end of the post 12 to fix the position of the post 12 with respect to the mat.

Figure 2:
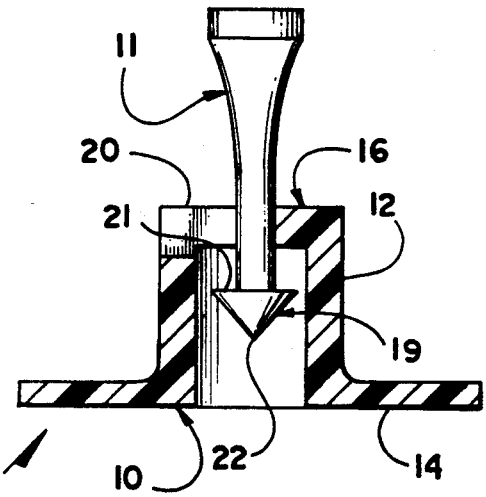
FIG. 2 is a diametrical cross sectional view taken substantially along the line 2—2 in FIG. 1, but showing the semi-rigid tee portion received by the base portion; and, FIG. 3 is an enlarged cross-sectional view showing a tee assembly made in accordance with the present invention received in a golf range mat.

With attention to FIGS. 1 and 2, it will be understood that the post 12 defines a central opening 15, partially closed at the upper end by the upper wall 16. Since the upper wall 16 must accommodate the tee portion 11, the upper wall 16 defines a center hole 18. Furthermore, in the embodiment here shown, the tee portion 11 will be separately made and subsequently inserted into the base portion 10. To facilitate insertion of the base 19 of the tee portion 11 through the wall 16, the wall 16 has slits 20. As here shown, there are three slits 20 spaced 120° apart. Those skilled in the art will understand that other slit arrangements may be utilized, so long as the arrangement satisfies the requirements stated herein.

The slits 20 extend from the hole 18 to the circumference of the post 10; and, the slits 20 extend down the post 12 somewhat as is best shown in FIG. 2.

The tee portion 11 comprises an upper end that is substantially like a conventional golfer's tee. The lower end of the tee portion, however, includes the base 19. The base 19 is here shown as conical in form, with the apex down. While other specific configurations are usable, it is important to have a generally flat surface 21 facing upwardly and a smaller flat or curved surface or dull point 22 facing downwardly. This will be understood better from the following discussion.

Figure 3:
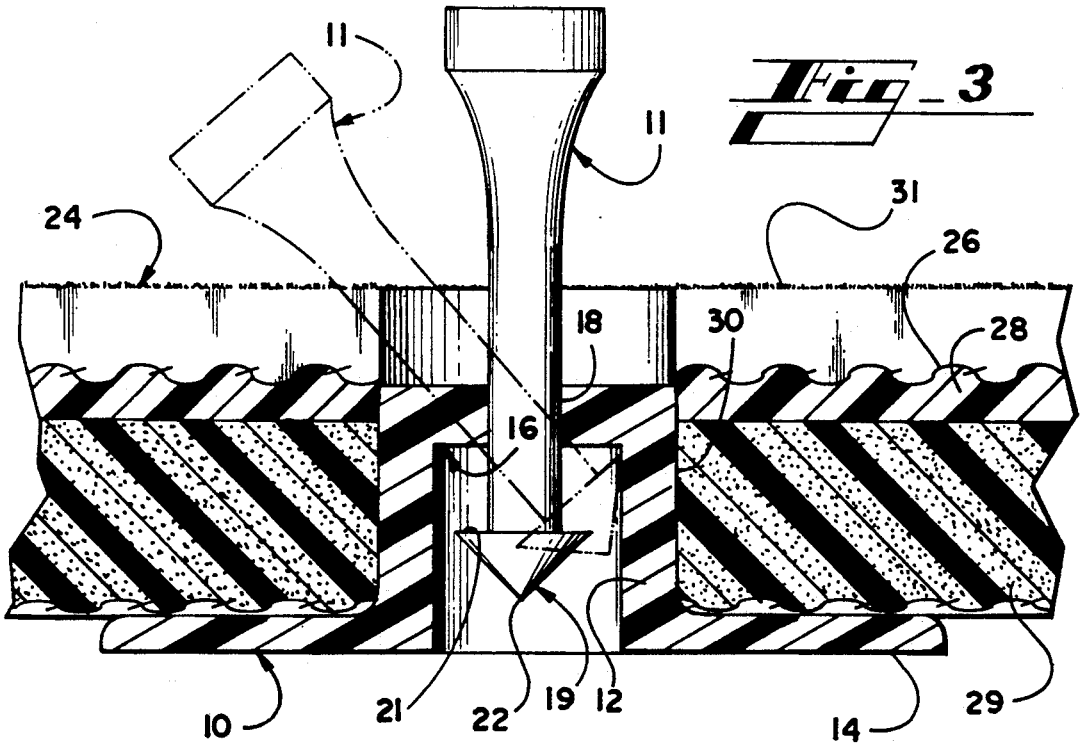

With the foregoing description in mind, attention is directed to FIG. 3 of the drawings which illustrates a tee assembly made in accordance with the present invention installed in a golf range mat.

The golf range mat in FIG. 3 is designated generally at 24, and includes face yarns 25 sewn into a primary backing 26. A precoat 28 covers the primary backing 26, and a pad 29 is fixed to the precoat 28. A fabric reinforcement 29 adds tear strength to the mat. This particular mat is disclosed in detail in U.S. Pat. No. 4,902,541, which is incorporated herein by reference, so no further description of the mat should be required. Also, those skilled in the art will understand that the particular mat construction here shown is by way of illustration only, and the tee assembly of the present invention may be used with any conventional golf range mat.

Conventionally, there is a hole through the mat 24 for receiving the tee. When using the tee assembly of the present invention, the hole 30 may or may not be somewhat tapered, so the hole 30 is smaller at the top than at the bottom. The taper is exaggerated in the drawing for purposes of illustration. Considering the construction of the tee assembly as described above, it will be recognized that the segments of the base portion 10 between the slits 20 can be urged out to allow the base 19 of the tee portion to pass through the upper wall 16 of the post 12. Once the tee portion has been received in the post 12, the segments of the wall 16 need to engage the tee portion 11 to hold it in the selected position. Thus, if the hole 30 is tapered as illustrated in FIG. 3, the hole 30 in the mat will urge the segments of the post 12 inwardly, so the periphery of the hole 18 will engage the tee portion 11 to hold the tee portion 11 in place. Alternatively, a straight sided post 12 may be used with a straight sided tee hole in the mat if a tapered core hole in the base is utilized (smaller at the top), and designed in size (core hole diameter) so as to somewhat restrict the sideways movement of the upper tee upon golf club head impact.

Use of the tee assembly of the present invention should now be understood. A generally semi-rigid tee portion 11 will be engaged with the base portion 10. The point 22 can be placed against the upper wall 16 and forcefully urged through the wall 16 into the opening 15. To facilitate the entrance of the base 19 through the wall 16, the base 19 may be turned on its edge so the flat surface 21 of either a conical or a flat base 19 will pass through the slits 20 in the wall 16.

With the base 19 within the opening 15, the edges of the center hole 18 will engage the sides of the tee portion 11 to hold the tee portion in the preset, vertical position. Further, with the base portion 10 received within the tapered hole 30 in the mat 24, the narrow upper end of the hole 30 will urge the segments of the wall 16 inwardly to engage the tee portion 11 with greater force.

It should be noticed in FIG. 3 that the upper wall 16 of the base portion 10 is disposed below the upper surface 31 of the mat 24. The optimum height for the base portion is such that the upper wall 16 is about at the base of the face yarns 25, but the base portion may be taller or shorter. The base portion may extend up to be just below the surface 31, or may extend only to a point below the base of the face yarns 25. With this arrangement, when the tee portion 11 is hit while driving a golf ball, the tee portion 11 will be urged to one side. If the tee portion 11 is lifted to remove the tee portion from the base portion 10, the base 19 will engage the upper wall 16 and prevent further motion, so the tee portion 11 will not be removed from the base portion 10. As the tee portion 11 is urged to one side, in a manner that would normally damage the mat 24, the tee portion will be held by the base portion 10. The resilient material of the base portion 10 will be somewhat distorted, but the tee portion 11 cannot engage the mat itself, so there can be little degradation of the golf mat 24 by the tee portion 11. The base portion 10 fits firmly within the hole 30, and is resilient. Coupled with the fact that the base portion 10 cannot be engaged by a golf club, the resilience of the base portion will prevent degradation of the golf mat 24.

Those skilled in the art will realize that the tee assembly of the present invention may be made of numerous materials. The base portion 10 may be made of rubber, or a thermoplastic elastomer. Successful prototypes have been formed of thermosetting and thermoplastic polyurethane, but polyolefins, nylons or the like when effectively formulated may be equally usable. The generally semi-rigid tee portion 11 may be made of other materials as long as they are not easily breakable but the tees can also be easily and inexpensively molded of a thermoplastic polyurethane, thermoplastic rubber, or other materials.

It will therefore be understood by those skilled in the art that the particular embodiment of the invention here shown is by way of illustration only, and is meant to be in no way restrictive; therefore, numerous changes and modifications may be made, and the full use of equivalents resorted to, without departing from the spirit or scope of the invention as outlined in the appended claims.

I claim:

1. A golf tee assembly in combination with a driving range mat, said combination comprising a tee assembly extending through a hole in said mat, said mat including a tufted fabric, and a pad fixed to said tufted fabric, said tee assembly comprising a base portion received within said hole in said mat, and a tee portion carried by said base portion and extending up, above said tufted fabric, said base portion defining a central opening, an upper wall partially closing said central opening, said tee portion including a base within said central opening, said base being of such size as not to pass by said upper wall so that said tee portion is generally inseparable from said base portion.

2. A golf tee assembly as claimed in claim 1, said base portion terminating below the upper surface of said tufted fabric, said tee portion extending above said upper surface for receiving a golf ball thereon.

3. A golf tee assembly as claimed in claim 2, said base portion defining a plurality of radial slits for dividing said upper wall into a plurality of segments, said upper wall defining a center hole for receiving said tee portion, said base portion being resilient so that said plurality of segments engage said tee portion to hold said tee portion in a selected vertical position.

4. A golf tee assembly as claimed in claim 3, said hole in said mat being tapered for urging said plurality of segments inwardly and for engaging said tee portion more strongly.

5. A golf tee assembly as claimed in claim 4, and including a flange at the lower end of said base portion, said flange determining the position of said base portion with respect to said mat.

6. A golf tee assembly as claimed in claim 5, said base portion being formed of an elastomeric material.

7. A golf tee assembly as claimed in claim 6, said tee portion being semi-rigid and formed of a thermoplastic elastomer.

8. A golf tee assembly as claimed in claim 7, said tee assembly being formed of polyurethane.

* * * * *